US007782717B2

(12) United States Patent
Gil et al.

(10) Patent No.: US 7,782,717 B2
(45) Date of Patent: Aug. 24, 2010

(54) ON-DEMAND DISPLAY DEVICE FOR A TIMEPIECE

(75) Inventors: Ramon Gil, Bellevue (CH); Jean-Claude Quenet, Chambrelien (CH)

(73) Assignee: Franck Müller Watchland S.A. (CH)

( * ) Notice: Subject to any disclaimer, the term of this patent is extended or adjusted under 35 U.S.C. 154(b) by 134 days.

(21) Appl. No.: 12/246,363

(22) Filed: Oct. 6, 2008

(65) Prior Publication Data

US 2009/0067295 A1 Mar. 12, 2009

Related U.S. Application Data

(63) Continuation-in-part of application No. 11/958,947, filed on Dec. 18, 2007, now abandoned.

(30) Foreign Application Priority Data

Dec. 23, 2006 (CH) ..... 2094/06
Dec. 19, 2007 (EP) ..... 07024597

(51) Int. Cl.
*G04B 19/00* (2006.01)

(52) U.S. Cl. ..... 368/69; 368/80; 368/223; 368/224

(58) Field of Classification Search ..... 368/69–70, 368/80, 223–225
See application file for complete search history.

(56) References Cited

U.S. PATENT DOCUMENTS

| | | | | | |
|---|---|---|---|---|---|
| 3,690,021 | A * | 9/1972 | Glass et al. | ..... | 434/304 |
| 3,911,667 | A * | 10/1975 | Komiyama | ..... | 368/38 |
| 4,247,933 | A * | 1/1981 | Nakamura | ..... | 368/269 |
| 4,271,493 | A * | 6/1981 | Tamaru et al. | ..... | 368/28 |
| 5,043,955 | A * | 8/1991 | Dubois et al. | ..... | 368/228 |
| 5,956,294 | A * | 9/1999 | Takizawa et al. | ..... | 368/37 |
| 6,370,087 | B1 * | 4/2002 | Akahane et al. | ..... | 368/110 |
| 6,826,122 | B2 * | 11/2004 | Zaugg | ..... | 368/28 |
| 7,496,003 | B2 * | 2/2009 | Muller | ..... | 368/228 |
| 2007/0091727 | A1 * | 4/2007 | Bonvin et al. | ..... | 368/107 |
| 2008/0144444 | A1 * | 6/2008 | Mahler et al. | ..... | 368/76 |
| 2008/0151698 | A1 * | 6/2008 | Gil et al. | ..... | 368/18 |
| 2008/0253235 | A1 * | 10/2008 | Hiraga et al. | ..... | 368/172 |

* cited by examiner

*Primary Examiner*—Vit W Miska
*Assistant Examiner*—Sean Kayes
(74) *Attorney, Agent, or Firm*—Ostrolenk Faber LLP

(57) ABSTRACT

The display device, which is arranged to display the minutes and hours, includes two cams (14 and 34) driven separately and respectively from the cannon pinion (11) and the hour wheel (31) of a horological movement. A lever (15, 35) held in the idle position by a spring (18, 38), is arranged so as to be actuated on demand by means of a push button (4) placed outside the corresponding timepiece, so as to make a rack (24, 44) pivot until the moment when a sensing finger (25, 45) of each rack abuts against the periphery of the corresponding cam. Each rack during its rotation drives a pinion (26, 46) carrying hands indicating the minutes and the hour.

14 Claims, 2 Drawing Sheets

ON-DEMAND DISPLAY DEVICE FOR A TIMEPIECE

CROSS-REFERENCE TO RELATED APPLICATIONS

The present application is a continuation-in-part of U.S. patent application Ser. No. 11/958,947, filed on Dec. 18, 2007, entitled ON-DEMAND DISPLAY DEVICE FOR A TIMEPIECE which claims priority to Swiss Patent Application No. 02094/06, filed on Dec. 23, 2006 entitled ON-DEMAND DISPLAY DEVICE FOR A TIMEPIECE, the entire disclosures of which are incorporated herein by reference. This application also claims priority to European Patent Application No. 07024597.2, filed on Dec. 19, 2007.

BACKGROUND

The present invention relates to the horological field and concerns more precisely a display device for a timepiece.

Many display devices for timepieces are known from the prior art, in particular for displaying information by the continuous or jumping driving of indicator members opposite suitable graduations, generally carried on a dial.

SUMMARY OF THE INVENTION

The object of the invention is a display device for a timepiece, driven by a base wheel of a horological movement, controlling the display of an indication member so that the latter displays, on demand, information relating to the current time or information concerning the functioning of the timepiece. Base wheel of the horological movement means any wheel intended to control, by means of the device, a hand, a disc or any time indication mechanism, in particular any wheel intended to control the display of the seconds, the minutes, the hours, the date, the day, the week, the month, the phases of the moon, the year or years, or any indication relating to the functioning of the timepiece, such as for example the remaining power reserve.

The on-demand display device is characterised by the fact that it comprises

- a cam having a periphery with a predefined shape and intended to be driven by the base wheel,
- a lever intended to be pivotally mounted, with reference to a frame element of the horological movement, between a standby position, associated with an idle position of the display member, and a stop position, associated with an indication position of the display member, the lever carrying a sensing finger intended to engage with the periphery of the cam in order to define the stop position, the lever also carrying a rack arranged in engagement with a pinion intended to drive the display member.

The device also comprises an elastic organ exerting a force on the lever in order to tend to position it in the standby position, and a control lever arranged to neutralise the elastic organ in response to the action of a user of the timepiece and enable the lever to position itself in the stop position in order to display the required information.

According to a preferred embodiment, the base wheel is the cannon pinion controlling the display of the minutes and the device is driven by a second base wheel of the timepiece, which is the hour wheel, which drives a second cam, a second lever, also maintained in the standby position by a second spring, being actuated manually on demand by means of the same push button systematically controlling the two levers so as to make a second rack turn on its axis, until the time when a finger of the second rack abuts on the second cam. During its rotation, the second rack drives a second pinion carrying a second time indication member, the cams having a configuration corresponding to the series of minutes or respectively hours to be displayed.

Each of the base wheels can transmit the rotation movement to the corresponding cam by means of a setting wheel meshing with a wheel integral with the cam, the base wheels travelling one turn in one hour or respectively in twelve hours.

By virtue of its characteristics, the display device according to the invention procures a mysterious character for the timepiece that it equips. Moreover, it also leaves clear the dial and improves the legibility of information displayed other than that displayed by the indicating members driven from the device.

The time indication members can be hands, discs or any device arranged to indicate the seconds, the minutes, the hours, the date, the day, the week, the month, the phases of the moon, the year, etc, or data relating to the functioning of the timepiece.

The pinions driven by the racks are preferably coaxial, the racks advantageously being placed on each side of the corresponding axis, each of the pinions carrying an indicating hand.

The two hands of the timepiece can be placed at midday when the levers controlling the racks are in the standby position.

BRIEF DESCRIPTION OF THE DRAWINGS

The drawing depicts, by way of example, an embodiment of the on-demand display device for a timepiece in which.

DESCRIPTION OF THE PREFERRED EMBODIMENTS

Figure 1:
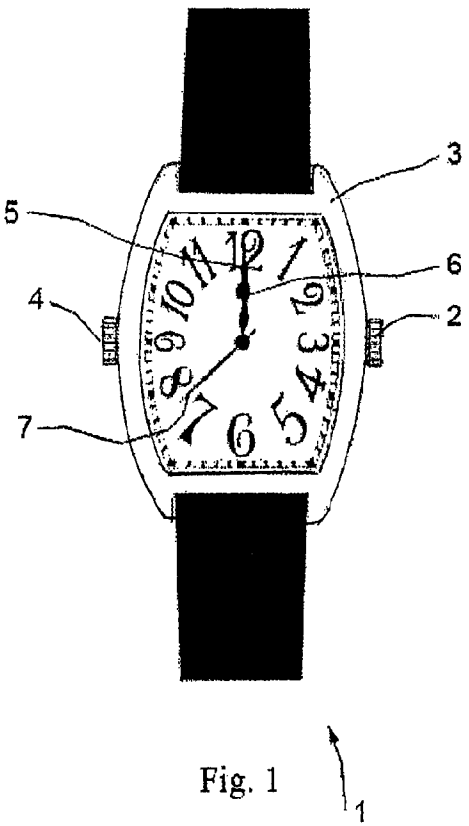
FIG. 1 is a front view of an example of a timepiece comprising a display device according to the invention and in which in particular two hands are visible, for the minutes and hours, in the idle position at twelve o'clock before the push button is actuated.

The timepiece 1 shown in FIG. 1 comprises a conventional winder 2 situated to the right of its case 3 and a push button 4 intended to control the display on demand of the minutes and hour placed to the left of the case.

As shown in FIG. 1 the hands indicating the minutes and the hour 5, 6 are placed at twelve o'clock when the push button 4 situated to the left of the case is not actuated. As soon as the push button is pressed, the device is actuated and the current minutes and hour are indicated as explained below in relation to FIGS. 2 and 3.

There is also shown an optional sweep second hand 7 at the centre, which can advantageously be driven permanently by the movement in order to indicate to the user of the watch that the movement is functioning normally.

Figure 2:
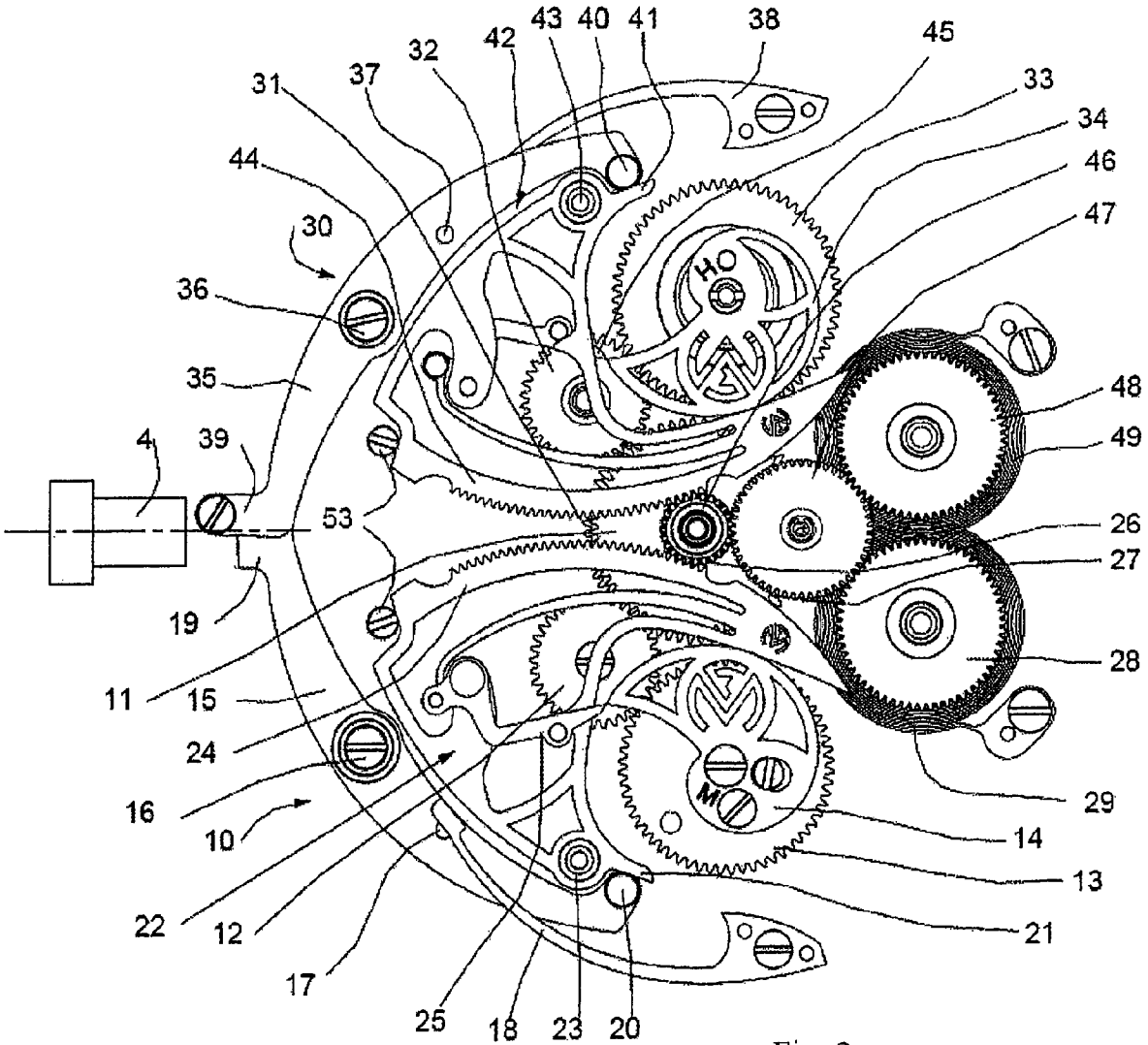
FIG. 2 is a simplified plan view of an exemplary embodiment of the display device according to the invention intended to display, on demand, the minutes and hours when the push button is actuated.
Figure 3:
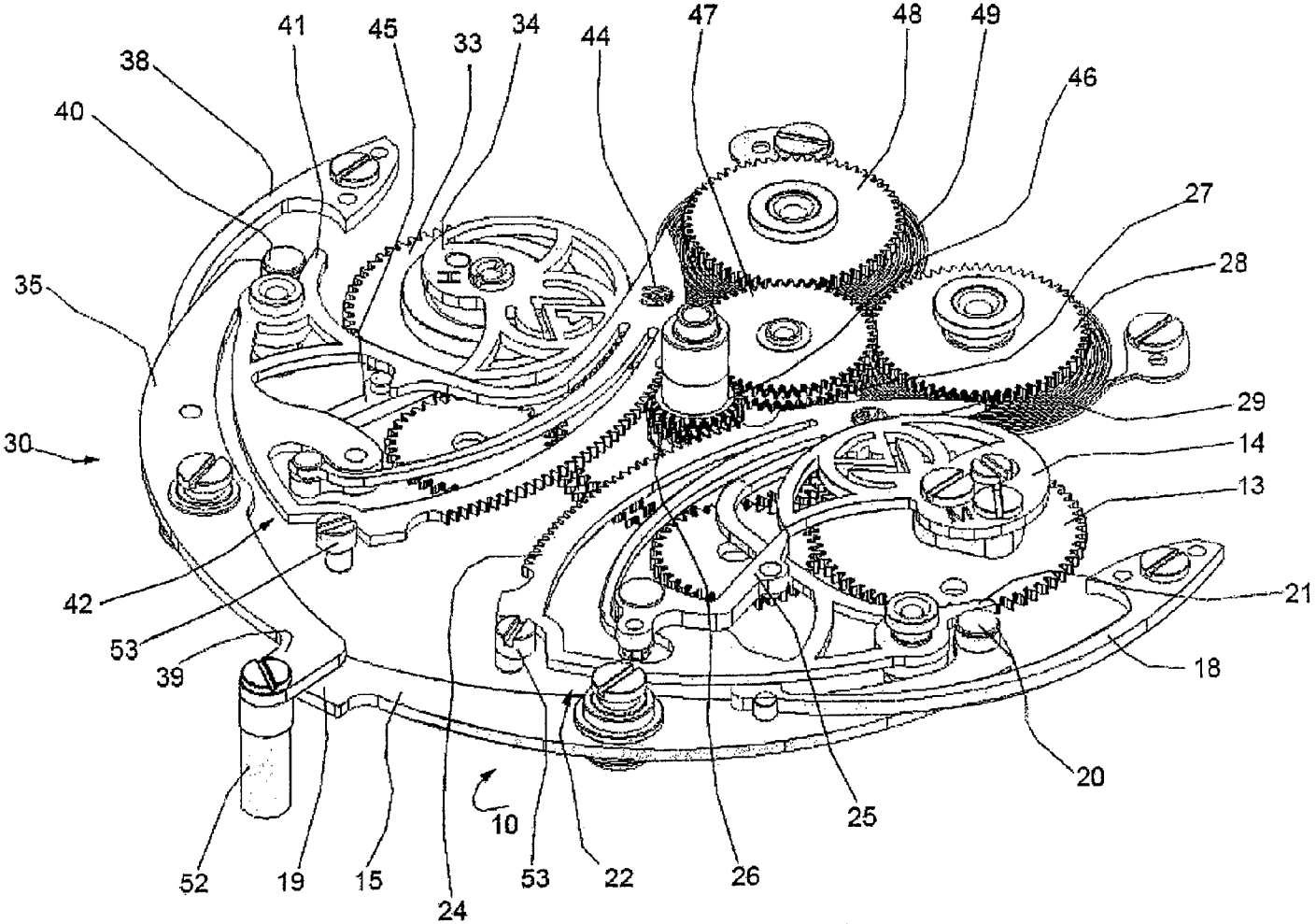
FIG. 3 is a simplified perspective view showing the functioning of racks placed at different heights, so as to be able to drive superimposed pinions carrying the hands.

On the bottom and right-hand parts respectively of FIGS. 2 and 3 there are shown a first part 10 of the display device that provides an indication of the minutes, while the part 30 of the display device, which indicates the hours, is placed at the top and left respectively of FIGS. 2 and 3.

If reference is made to the part of the device relating to the display on demand of the minutes of the timepiece, it is clear from FIGS. 2 and 3 that this has a base wheel 11, referred to as a cannon pinion, it being understood that it travels one turn in one hour and is intended to control the display of the minutes. The base wheel or cannon pinion 11 transmits the movement of the going train (not shown for more clarity) of the timepiece to a setting wheel 12 that drives a wheel 13 integral with a cam 14 while being coaxial with it, the corresponding gear ratio being such that the cam performs one turn in one hour.

A first actuation lever 15 of the display device is pivotally mounted, on an axis 16, on the frame of the movement. This lever comprises a spring stop 17 on which a spring 18 acts in order to hold the lever in a standby position, which is the one visible in the figures. The lever comprises a first end 19 intended to undergo a pressure force resulting from the actuation of the push button 4, actuated manually on demand from outside the timepiece. The lever also carries a pin 20 at its second end.

This is arranged to act on a beak 21 of a lever 22 mounted pivotally on the frame of the movement on an axis 23 situated close to the beak. The lever 22 also carries a rack 24 and a sensing finger 25 intended to engage with the periphery of the cam 14.

The lever 22 is disposed on the movement so that the rack 24 can mesh with a pinion 26, arranged here at the centre of the movement, itself in engagement with a return system comprising a setting wheel 27 meshing with a wheel 28 integral with a first end of a pre-stressed spiral spring 29 and the second end of which is secured to the frame of the horological movement.

The return system is configured so that, when the push button 4 is actuated in order to act on the lever 15 and thus release the beak 21 of the lever 22, the spiral spring 29 acts on the pinion 26, by means of the wheel 28 and the setting wheel 27, in order to make the rack 24 turn in the clockwise direction until its sensing finger 25 abuts against the periphery of the cam 14.

During this rotation movement, the pinion 26, which is intended to carry the minute hand 5, is driven until the hand indicates the current minute, because of the configuration of the cam 14 defining the angular amplitude of the rotation of the lever 22 at this moment, with reference to its standby position.

As soon as the pressure applied to the push button 4 is interrupted, the lever 15 goes back up to its standby position under the effect of the force exerted by the spring 18 and the hand indicating the minutes 5 returns to its twelve o'clock position.

In a similar manner to above, the part 30 of the device, relating to the indication of the time on demand, comprises an hour wheel 31 that transmits the movement from the going train to a wheel 33 by means of a setting wheel 32. The wheel 33 is integral with a cam 34, the hour wheel 31, just like the cam 34, making one turn in twelve hours.

A second actuation lever 35 of the display device is pivotally mounted, on an axis 36, on the frame of the movement. This lever comprises a spring stop 37 on which a second spring 38 acts in order to hold the lever in a standby position, which is the one visible in the figures. The lever comprises a first end 39 intended to be subjected to a pressure force resulting from the actuation of the push button 4, actuated manually on demand from outside the timepiece. The lever also carries a pin 40 at its second end.

This is arranged to act on a beak 41 of a second lever 42 mounted pivotally on the frame of the movement on an axis 43 situated close to the beak 41. The lever 42 also carries a second rack 44 and a second sensing finger 45 intended to engage with the periphery of the second cam 34.

The lever 42 is disposed on the movement so that the rack 44 can mesh with a pinion 46, coaxial with the pinion 26, and also in engagement with a return system comprising a setting wheel 47, superimposed on the setting wheel 27 and meshing with a wheel 48 integral with a first end of a pre-stressed spiral spring 49 and the second end of which is integral with the frame of the horological movement.

The return system is configured so that, when the push button 4 is actuated in order to act on the lever 35 and thus release the beak 41 of the lever 42, the spiral spring 49 acts on the pinion 46, by means of the wheel 48 and the setting wheel 47, in order to make the rack 44 turn in the anti-clockwise direction until its sensing finger 45 abuts against the periphery of the cam 34.

During this rotation movement, the pinion 46, which is intended to carry the hour hand 6, is driven until the moment when the hand indicates the current hour, because of the configuration of the cam 34 defining the angular amplitude of the rotation of the lever 42 at this moment, with reference to its standby position.

As soon as the pressure applied to the push button 4 is interrupted, the lever 35 goes back to its standby position under the effect of the force exerted by the spring 38 and the hand indicating the hours 6 returns to its twelve o'clock position.

It should be noted that, because the pinions 26 and 46 are caused to turn in opposite directions when the push button 4 is actuated, the spiral springs 29 and 49 can advantageously be wound in opposite directions with respect to each other.

Advantageously, the end 39 of the second lever 35 carries a pin 52 on which the action of the push button 4 is exerted. This pin is arranged so as to act itself on the end 19 of the lever 15 during an actuation of the push button 4, so that the two levers 15 and 35 are actuated at the same time in order to simultaneously control the movements of the indicating hands 5 and 6 and display the current hour.

In addition, it should be noted that provision can advantageously be made for the standby position of each of the levers 22, 42 to be able to be adjusted by means of an eccentric 53, mounted on the movement frame and defining a stop for the lever when it returns to its standby position under the effect of the force exerted by the corresponding spring 18, 38.

The present description devotes itself to describing an embodiment of the invention in a non-limiting manner and it goes without saying that a person skilled in the art will not encounter any particular difficulty in adapting some of the constituent elements of the display device to his own requirements, without departing from the scope of the present invention.

For example, the return system described may be modified to use, as an alternative, straight springs rather than the spirals 29 and 49, these straight springs then acting on a pin carried by a wheel connected cinematically to the corresponding pinion by means of a step-down gear train.

Moreover, as mentioned in the introduction, the device that has just been described is not limited to the indication of the minutes and hours in a timepiece. Indeed, one or other of the two parts 10 and 30 of this device can be used to indicate any display relating to time data. It can thus be used to indicate the seconds, the date, the day, the week, the month, the phases of the moon or the year. It can alternatively be used to indicate, on demand, other displays such as the remaining power reserve of a timepiece or any other indication relating to the functioning of the timepiece.

What is claimed is:

1. A display device for a timepiece intended to be driven from a base wheel of a horological movement in order to control movements of a display member displaying an indication relating to time or to functioning of said timepiece, said display device comprising a cam having a periphery of predefined shape and arranged to be driven by said base wheel, a lever arranged to be pivotally mounted, with reference to a frame element of said horological movement, between a standby position, associated with an idle position of said display member, and a stop position associated with an indication position of said display member, said lever carrying a sensing finger arranged to cooperate with said periphery of said cam in order to define said stop position, said lever also carrying a rack arranged in engagement with a pinion intended to drive said display member, an elastic organ exerting a force on said lever in order to tend to position the latter in said standby position, a control lever arranged to neutralise said elastic organ in response to action of a user of said timepiece and enable said lever to position itself in said stop position.

2. The display device of claim 1, intended to be driven also by a second base wheel of said horological movement, and being intended also to control movements of a second display member, said display device comprising a second cam having a periphery of predefined shape and arranged to be driven by said second base wheel, a second lever arranged to be mounted so as to pivot, with reference to a frame element of said horological movement, between a standby position associated with an idle position of said second display member and a stop position associated with an indication position of said second display member, said second lever carrying a second sensing finger arranged to cooperate with said periphery of said second cam in order to define said stop position, said second lever also carrying a second rack arranged in engagement with a second pinion intended to drive said second display member, a second elastic organ exerting a force on said second lever in order to tend to position it in said standby position, a second control lever arranged so as to neutralise said second elastic organ, simultaneously with neutralisation of said first elastic organ, in response to action of a user of said timepiece, and so as to enable said second lever to position itself in said stop position.

3. The display device of claim 2, wherein said pinions are coaxial and wherein said racks are disposed on each side of a corresponding axis while being arranged so as to pivot in opposite directions in response to action of a user of said timepiece.

4. The display device of claim 3, further comprising a return system arranged so as to exert a second force on each lever lower than that exerted by said corresponding elastic organ and tending to position it in its stop position.

5. The display device of claim 2, further comprising a return system arranged so as to exert a second force on each lever lower than that exerted by said corresponding elastic organ and tending to position it in its stop position.

6. A timepiece comprising a case housing a horological movement according to claim 5, at least one display member for displaying a quantity taken from the group comprising seconds, minutes, hours, date, day, week, month, phases of the moon, year, etc, or data relating to functioning of said timepiece, the latter also comprising a push button arranged so as to allow movement of said display member from an idle position to a position indicating said quantity to be displayed in response to an action of a user of said timepiece.

7. The display device of claim 1, further comprising a return system arranged so as to exert a second force on each lever lower than that exerted by said corresponding elastic organ and tending to position it in its stop position.

8. A horological movement for a timepiece comprising a base wheel, driven according to an indication relating to time or to functioning of said horological movement, and a display device for controlling movements of a display member to indicate a quantity representing said indication relating to time or to functioning of said horological movement, said display device comprising a cam having a periphery of predefined shape and arranged to be driven by said base wheel, a lever arranged to be mounted so as to pivot, with reference to a frame element of said horological movement, between a standby position associated with an idle position of said display member and a stop position associated with an indication position of said display member, said lever carrying a sensing finger arranged to cooperate with said periphery of said cam in order to define said stop position, said lever also carrying a rack arranged in engagement with a pinion intended to drive said display member, an elastic organ exerting a force on said lever so as to tend to position it in said standby position, a control lever arranged so as to neutralise said elastic organ in response to action of a user of said timepiece and to enable said lever to position itself in said stop position.

9. The horological movement of claim 8, comprising a second base wheel driven according to a second indication relating to time or to functioning of said horological movement, said display device being arranged so as to control movements of a second display member in order to indicate a quantity representing said second indication relating to time or to functioning of said horological movement, and comprising a second cam having a periphery of predefined shape and intended to be driven by said second base wheel, a second lever intended to be mounted so as to pivot, with reference to a frame element of said horological movement, between a standby position associated with an idle position of said second display member and a stop position associated with an indication position of said second display member, said second lever carrying a second sensing finger intended to engage with said periphery of said second cam in order to define said stop position of said second lever, the latter also carrying a second rack arranged in engagement with a second pinion intended to drive said second display member, a second elastic organ exerting a force on said second lever in order to tend to position it in its standby position, a second control lever arranged so as to neutralise said second elastic organ, simultaneously with neutralisation of said first elastic organ, in response to action of a user of said timepiece and so as to enable said second lever to position itself in its stop position.

10. The horological movement of claim 9, said display device further comprising a return system arranged so as to exert a second force on each lever lower than that exerted by said corresponding elastic organ and tending to position it in its stop position.

11. The horological movement of claim 9, wherein it comprises a going train arranged so as to drive said first base wheel in order to make a complete turn in one hour and said second base wheel so as to make a turn in twelve hours, said display device being arranged so as to control movements of a first member displaying the current minute and a second member displaying the current hour.

12. A timepiece comprising a case housing a horological movement according to claim 9, at least one display member for displaying a quantity taken from the group comprising seconds, minutes, hours, date, day, week, month, phases of the moon, year, etc, or data relating to functioning of said timepiece, the latter also comprising a push button arranged so as to allow movement of said display member from an idle position to a position indicating said quantity to be displayed in response to an action of a user of said timepiece.

13. The timepiece of claim 12, wherein it comprises first and second indicating hands for displaying respectively minute and hour, and wherein said first and second indicating hands have a common idle position at twelve o'clock.

14. The horological movement of claim 8, said display device further comprising a return system arranged so as to exert a second force on each lever lower than that exerted by said corresponding elastic organ and tending to position it in its stop position.

* * * * *